United States Patent [19]

Kaplan

[11] Patent Number: 5,043,851

[45] Date of Patent: Aug. 27, 1991

[54] POLYGONAL CHEMILUMINESCENT LIGHTING DEVICE

[75] Inventor: Fred Kaplan, San Francisco, Calif.

[73] Assignee: Omniglow Corporation, Novato, Calif.

[21] Appl. No.: 582,440

[22] Filed: Sep. 13, 1990

[51] Int. Cl.[5] ..... F21K 2/06

[52] U.S. Cl. ..... 362/34; 362/396

[58] Field of Search ..... 362/34, 157, 158, 171, 362/178, 396

[56] References Cited

U.S. PATENT DOCUMENTS

| | | | |
|---|---|---|---|
| 3,350,553 | 10/1967 | Cline : | |
| 3,354,328 | 11/1967 | Shefler et al. . | |
| 3,500,033 | 3/1970 | Cole, Jr. et al. . | |
| 3,539,794 | 11/1970 | Rauhut et al. . | |
| 3,576,987 | 5/1971 | Voight et al. . | |
| 3,584,211 | 6/1971 | Rauhut . | |
| 3,612,857 | 10/1971 | Beatty et al. . | |
| 3,720,823 | 3/1973 | Black et al. . | |
| 3,745,324 | 7/1973 | Shefler et al. . | |
| 3,764,796 | 10/1973 | Gilliam et al. . | |
| 3,774,022 | 11/1973 | Dubrow et al. . | |
| 3,781,536 | 12/1973 | Naeseth et al. | 362/34 |
| 3,808,414 | 4/1974 | Roberts . | |
| 3,813,534 | 5/1974 | Gilliam . | |
| 3,819,925 | 6/1974 | Richter et al. . | |
| 3,847,279 | 11/1974 | Montogomery . | |
| 3,861,072 | 1/1975 | Holcombe | 362/34 |
| 3,875,602 | 4/1975 | Miron . | |
| 3,893,938 | 7/1975 | Rauhut . | |
| 4,061,910 | 12/1977 | Rosenfeld | 362/34 |
| 4,064,428 | 12/1977 | Van Zandt . | |
| 4,104,708 | 8/1978 | Bohli | 362/34 |
| 4,193,109 | 3/1980 | Heffernan et al. . | |
| 4,635,166 | 1/1987 | Cameron | 362/34 |
| 4,740,874 | 4/1988 | Wylie et al. | 362/396 |
| 4,814,949 | 3/1989 | Elliott . | |

OTHER PUBLICATIONS

U.S. Trademark Reg. no. 1,526,721 registered Feb. 28, 1989.

*Primary Examiner*—Ira S. Lazarus
*Assistant Examiner*—Richard R. Cole
*Attorney, Agent, or Firm*—Majestic, Parsons, Siebert & Hsue

[57] ABSTRACT

A polygonal outer shell providing improved light transmission characteristics for chemiluminescent lighting devices. The corners created by incidence of the surfaces that comprise the shell create a fiber optic effect by concentrating the light in the corners, thus enhancing visibility of light emanating from the light stick and optimizing the amount and distribution of light radiated from the device. Furthermore, a hook-shaped tip by which the light may be suspended from means of horizontal support. In an alternate embodiment, the hook defines an opening and a quick release locking device which allows quick insertion of means of horizontal support into the eye and simultaneously prevents the support from disengaging therefrom unless the locking device is released.

16 Claims, 1 Drawing Sheet

POLYGONAL CHEMILUMINESCENT LIGHTING DEVICE

BACKGROUND OF THE INVENTION

1. Field of the Invention

This invention relates to chemiluminescent lighting devices which provide chemical light. The invention more particularly pertains to the provision of an optically improved outer shell or body for such lighting devices. The invention also pertains to an improved means used to suspend such devices from horizontal supports.

2. Description of the Prior Art

Chemiluminescent lighting devices or light sticks, as they are more commonly known, contain at least two sealed compartments. Each compartment contains one of two chemical components which, when admixed, react to produce chemical light. A device of this type is shown in U.S. Pat. No. 3,576,987, issued May 4, 1971. With this type of light stick, the compartments are defined by a sealed vial contained within a translucent outer body or shell. Only a single vial is required, as the outer shell or body contains the second chemical component. When the body is flexed enough to break the vial, which may be of a breakable material such as glass, the chemicals are released and mixed within the body. The chemical reaction that ensues produces light for up to twelve hours.

Another prior art light stick which is similar is shown in U.S. Pat. No. 4,508,642. With either of the prior art devices, they are generally tubular in shape with an open end for filling. The open end is sealed by means of a plug and the opposite end is closed. The opposite end may be closed by crimping or molding or other satisfactory means. The opposite end frequently includes an aperture for hanging or suspending the device from a horizontal support, such as a nail or line. The last-named patent shows a molded-in tip having an aperture therethrough.

Other than a single vial, some prior art devices utilize two vials. One such device which uses concentric vials is shown in U.S. Pat. No. 4,193,109, issued Mar. 11, 1980. Other constructions do not use a tubular outer shell. For example, U.S. Pat. No. 3,539,794 issued Nov. 10, 1970, shows the use of plastic pouches. Another construction of interest is found in U.S. Pat. No. 4,814,949 issued Mar. 21, 1989, wherein a shallow container has one or a plurality of glass vials therein. With the latter device, an absorbent material is used to spread the chemiluminescent compositions into a wider shape.

The prior art lighting devices thus described have some disadvantages. The typical tubular body of translucent plastic material inherently gives a rather diffuse light. Such is also the case with the pouch and shallow container devices. It is often desirable to intensify the light for various reasons, such as to enhance visibility from a distance. Another disadvantage with prior art tubular devices is that a limited lighting surface area results due to the limited volume of chemicals in each light stick.

In one application of such devices, light sticks are tied to long lines used in commercial fishing and are thus used underwater. A single long line trailed from a fishing boat in the ocean may reach up to sixty miles in length suspended by floats. Vertically descending from the long line at spaced intervals are a plurality of hook lines having hooks at spaced intervals.

When paying out the lines, light sticks are fastened adjacent to the hooks for the purpose of attracting fish. The light sticks are commonly tied to the lines using rubber bands or a small length of line passed through the aperture in the top of the closed end of the device. Because they have to be tied, time is expended in fastening the light sticks to the lines. Time is also required to remove the spent light sticks from the line when it is reeled in after the fish have been hooked. The time thus expended reduces the fishing time available and therefore the catch.

The prior art devices lack the means for quick attachment and detachment. It is therefore the primary object of this invention to provide an improved light stick which overcomes the above-mentioned disadvantages.

It is a further object to provide such a light stick device that has enhanced optics so as to produce a less diffuse and more visible light effect.

It is a further object to provide a device that, for the same chemical volume as a tubular design light stick, has an increased lighting surface area.

It is a further object to provide such a device that has an improved mounting means that allows the device to be quickly attached and detached from a support.

These and other objects and advantages will become more readily apparent from a review of the following description.

SUMMARY OF THE INVENTION

The invention takes the form of a polygonal outer shell or body for a chemiluminescent lighting device. In particular, it takes the form of such a device having a plurality of planar side surfaces which define therebetween intersecting corners where the planes meet. These intersecting corners are advantageous in that they concentrate the chemical light generated within the device and produce a plurality of bright lines for viewing. A kind of fiber optic effect occurs which results in the corners being brighter and therefore more visible than would be the case with a non-polygonal body.

The fiber optic effect enhances the visibility and radiation characteristics of the lighting device. This enhancement is especially useful when the light is to be used as a marker in environments where visibility is poor. An example would be in heavy weather. Another would be in ocean waters where commercial fishing is done. Such bodies of water are very large and exhibit great depth. It is well known that the penetration of surface light diminishes in direct proportion to depth so that deep ocean environments may be thought of as having no background light at all. Ocean environments also contain suspended particulate matter such as salt and debris which also inhibits visibility.

Another advantage of having a polygonal shape is that the resultant light stick's lighting surface will increase compared to the prior art tubular light stick. It will be taller for a given volume of chemicals. This results in greater light distribution for the same amount of chemicals.

The number of surfaces may be three or greater. The cross-sections of the device are thus triangular, square, pentagonal, hexagonal, etc. The number of surfaces corresponds with the number of corners.

The invention also includes a suspension means in the form of a hook at the top of the device. The hook permits quick suspension of the device on a line, e.g. a fishing line. The hook also optionally includes a locking means so that it may not fall off the line. Frequently, when fish hit the fishhook or the line itself, the device may be shaken off. The hook may be combined with the common aperture for hanging on a projection such as a nail.

DETAILED DESCRIPTION

Figure 2:
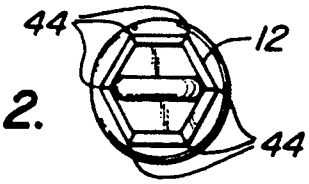
FIG. 2 is a top plan view of the same.
Figure 4:
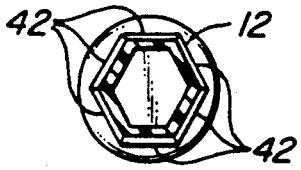
FIG. 4 is a cross-sectional view taken along lines 4–4 in FIG. 1.
Figure 1:
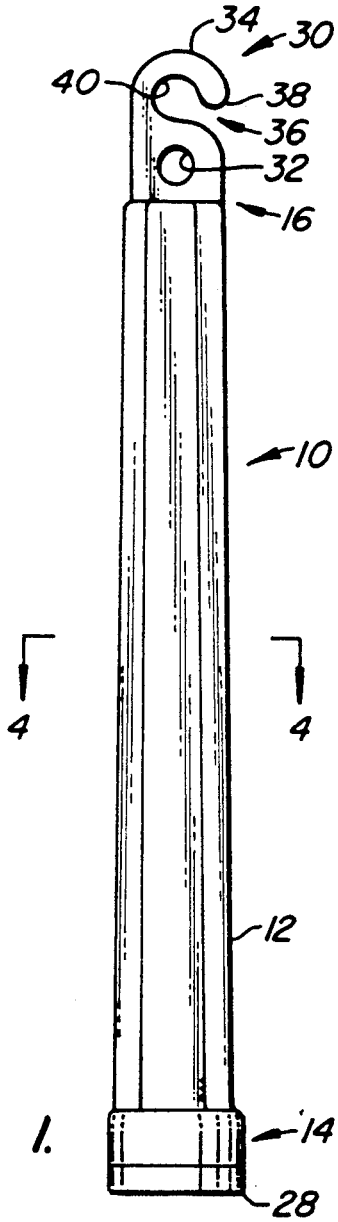
FIG. 1 is a front elevation view of a preferred embodiment of the chemiluminescent lighting device of the present invention, which is hexagonal in cross-section.
Figure 3:
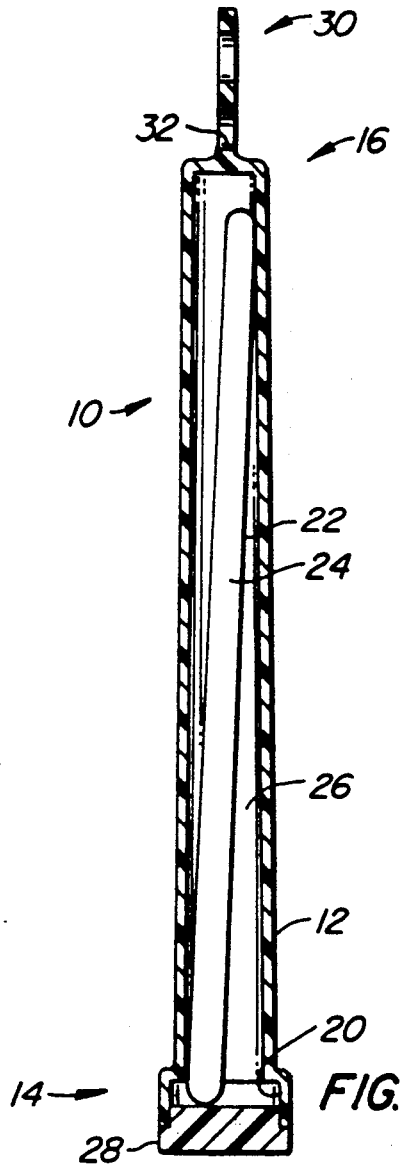
FIG. 3 is a cross-sectional view of the same taken along lines 3—3 in FIG. 1.

The preferred embodiment of the invention is shown in FIGS. 1–4. It may be understood that, while a polygonal device with a hexagonal cross-section is shown for the sake of convenience, many other cross-sections from triangular, etc., can also be utilized. In FIG. 1, there is shown generally a chemiluminescent lighting device or light stick 10. The device comprises an elongated, generally tubular shell or body 12. The body may be made of translucent plastic material such as polypropylene or polyethylene. The body may range in height from one inch to 36 inches, and in width from ¼ inch to 36 inches. As shown, the body is slightly tapered from its open proximal end 14. As best seen in FIG. 2, the body 12 has a stepped base 18 (round, as shown, or polygonal) having an opening 20 for purposes of filling. The body is filled in the inverted position with a sealed, elongated glass vial 22 containing a first chemical constituent 24. The second chemical constituent 26 is then flowed around the vial (or could be contained in a second glass vial) and the opening 20 closed with a plug 28 which is sealed in the opening 20 by gluing, heat sealing or inertia friction welding. With the last method, the plug 28 is rotated relative to the body 12 in frictional contact and an upset pressure applied.

The entire body is molded by using the plastic injection molding or extrusion processes. Also formed during this process is a means for suspending the light stick, in the form of a projection 30 which has a hole or aperture 32 molded therethrough for facilitating hanging on a projection such as a nail. Located above this hole 32 is an arcuate member in the form of a hook 32. The open side 36 of the projection 30 permits the entry of a line or other long suspension means into the eye of the hook. Because the point 38 of the hook is below the center line of the inner arc 40 of the hook eye, it will resist disengagement from the line.

As may be seen from FIG. 2, the hexagonal shape shown provides six planar surfaces 42 which intersect at a corresponding number of corners 44. While a hexagonal shape is shown, it is to be understood that three or more planar surfaces producing triangular, square, pentagonal, etc. shapes are also contemplated.

Figure 5:
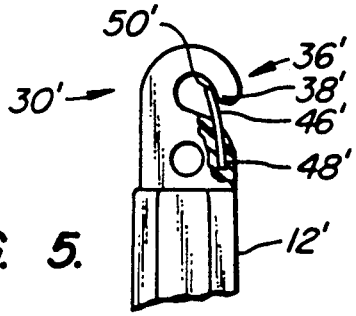
FIG. 5 is a side elevation view of an alternate embodiment of the hook suspension portion of the device, partially cut away to show details thereof.
Figure 6:
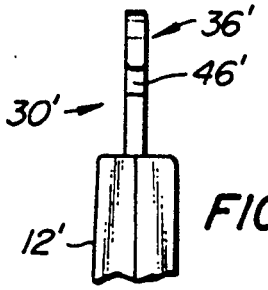
FIG. 6 is an end elevation view of the alternate embodiment shown in FIG. 5.

Turning to FIGS. 5 and 6, there is shown an alternate embodiment wherein a locking means is provided for positively retaining the hook 34' on a line. This locking means is in the form of a steel leaf spring 46' having a fixed end 48' thereof molded into the projection 30', which is bent when the line is laterally inserted through open side 36', but then springs back to close the open side after the line has been inserted. By pressing on the leaf spring 46', its free end 50' may be moved from its blocking position in contacting relation with tip 38' so that the light stick may be removed from the line.

It is to be understood that, while the invention has been described above in conjunction with the preferred specific embodiments, the description and examples are intended to illustrate and not limit the scope of the invention, which is defined by the scope of the appended claims.

What I claim as my invention is:

1. In a chemiluminescent lighting device of the type having fluids in a container body that are mixed to chemically react and thereby provide chemical light, the improvement comprises:

means defining at least three planar surfaces on said body, said surfaces intersecting along at least three lines of incidence, wherein said planar surfaces meet to provide intersecting corners for concentrating chemical light generated within the container body so as to produce a plurality of bright lines for viewing.

2. The invention of claim 1 wherein said body defines a polygonal cross-section.

3. The invention of claim 2 wherein the number of surfaces is greater than three.

4. The invention of claim 1 wherein said body defines a height between a pair of opposite ends and a width.

5. The invention of claim 4 wherein said height is within a range from 1 to 36 inches.

6. The invention of claim 4 wherein said width is within a range from ¼ to 36 inches.

7. The invention of claim 4 wherein one of said opposite ends includes a projection used to provide support for the device, comprising a hook-shaped member defining an eye.

8. The invention of claim 7 further including locking means associated with said hook member permitting a horizontal support member to be placed into said eye through said open side and preventing removal therefrom unless said locking means is opened.

9. The invention of claim 8 further including an aperture in said projection for admitting a horizontal support member.

10. The invention of claim 9 wherein said eye is spaced from said aperture in said projection.

11. The invention of claim 10 wherein said eye is above said aperture in said projection.

12. In a chemiluminescent lighting device of the type having fluids in a container body that are mixed to chemically react and thereby provide chemical light, the improvement comprises:

means defining at least three planar surfaces on said body, said surfaces intersecting along at least three lines of incidence, wherein said planar surfaces meet to provide intersecting corners for concentrating chemical light generated within the container body so as to produce a plurality of bright lines for viewing, said device further defining a pair of opposite ends, one of said ends including a projection used to provide support for the device in a suspended state, including a hook shaped member defining an eye and an open side for admitting a horizontal support member, and an aperture in said projection for admitting a horizontal support member.

13. The invention of claim 12 further including locking means associated with said hook member permitting a horizontal support to be placed into said eye through said open side, and preventing removal therefrom unless said locking means is opened.

14. The invention of claim 12 wherein said eye is spaced from said aperture in said projection.

15. The invention of claim 14 wherein said eye is above said aperture in said projection.

16. In a chemiluminescent lighting device of the type having fluids in a container body that are mixed to chemically react and thereby provide chemical light, the improvement comprises:

means defining at least three planar surfaces on said body, said surfaces intersecting along at least three lines of incidence, wherein said planar surfaces meet to provide intersecting corners for concentrating chemical light generated within the container body so as to produce a plurality of bright lines for viewing, and wherein said device has an increased lighting surface compared to a device having a generally tubular shape with the same given volume of fluids.

* * * * *